US005120056A

United States Patent [19]

Gharemani

[11] Patent Number: 5,120,056

[45] Date of Patent: Jun. 9, 1992

[54] STRINGING TOOL FOR SPORTS RACKETS

[76] Inventor: Pascal Gharemani, 100 W. 92nd St., Apt. 9H, New York, N.Y. 10025

[21] Appl. No.: 479,452

[22] Filed: Feb. 13, 1990

[51] Int. Cl.[5] ..... A63B 51/14

[52] U.S. Cl. ..... 273/73 B

[58] Field of Search ..... 273/73 R, 73 A, 73 B

[56] References Cited

U.S. PATENT DOCUMENTS

| | | | |
|---|---|---|---|
| 2,091,654 | 8/1937 | Roberts | 273/73 B |
| 2,188,250 | 1/1940 | Serrano | 273/73 A |
| 2,246,109 | 6/1941 | Serrano | 273/73 A |
| 3,823,609 | 7/1974 | Miyagawa et al. | 273/73 A X |
| 3,913,912 | 10/1975 | Smith | 273/73 A |
| 3,988,022 | 10/1976 | Halbrook | 273/73 A |
| 4,125,259 | 11/1978 | Halbrook | 273/73 A |
| 4,311,069 | 1/1982 | Walker | 273/73 B |
| 4,484,742 | 11/1984 | McCrone | 273/73 A |

FOREIGN PATENT DOCUMENTS 471851 9/1937 United Kingdom ..... 273/73 B

*Primary Examiner*—Theatrice Brown
*Assistant Examiner*—William E. Stoll
*Attorney, Agent, or Firm*—Darby & Darby

[57] ABSTRACT

A portable, hand-held string tensioning device for tensioning a selected string portion of a sports racket includes a support bracket attached to the body portion of the device for supporting the body portion against the outside peripheral surface of the racket frame, a rod whose forward end is slidably attached to the body portion of the device and is movable relative to the support bracket, and a clamp for selectively clamping an end of the string portion protruding through one of a plurality of apertures located along the outside peripheral frame. A hand trigger is pivotably connected to the body portion and is adapted to engage and advance the rod in a forward direction to tension the string portion. The hand trigger is positioned such that it can be operated with only one hand.

6 Claims, 3 Drawing Sheets

STRINGING TOOL FOR SPORTS RACKETS

FIELD OF THE INVENTION

The present invention relates to a stringing tool for attaching and tensioning the strings of a sports racket, such as a tennis racket, to the racket frame.

BACKGROUND OF THE INVENTION

Sports rackets used in such sports as tennis, squash, and badminton are made from a generally oval frame of laminated wood, metal or composite materials and include an integral handle or grip. The open area within the oval frame is covered with criss-crossing strings, usually made from nylon. The pattern of criss-crossing is usually vertical columns (main strings) and horizontal rows, with respect to the handle. Although multi-string lengths (one length of string for each vertical column and horizontal row) have been used with some rackets, the rackets available today generally consist of a single length, or two lengths of nylon string (i.e, one length for the columns and one for the rows). U.S. Pat. No. 4,484,742 describes a multi-string racket. The separate lengths of string are laced through appropriate apertures located along the perimeter of the racket frame.

The procedure for stringing rackets using a single length string requires the use of a stringing machine having a frame brace attachment which prevents the frame from warping during the tensioning of the strings. The prior art procedure for stringing the rackets mounted in the stringing machine begins with the main (vertical) strings followed by the installation of the horizontal strings. The brace prevents warping or structural damage of the frame due to the uneven tension of strings. For example, tensioning only the main strings will pull the frame longitudinally and will probably warp it or break it without the frame brace.

The machines currently used to string sports rackets and apply the precise tension to each row and column of the string are generally large, heavy, immobile machines and require trained personnel for their operation.

U.S. Pat. No. 4,484,742 offers an alternative hand-held stringing machine that can be used without the need for clamping the racket frame, however the hand held device disclosed in U.S. Pat. No. 4,484,742 is designed only for use with multi-length strings. The device disclosed in U.S. Pat. No. 4,484,742 includes the use of a cone-shaped anchor positioned at each open end of each string length (two per column lengths and row lengths). The anchor is designed to compress about the string at a point adjacent the frame. The force of compression of each anchor is provided by the tension residing in the string length after tensioning. The result with the device and system disclosed in U.S. Pat. No. 4,484,742 is that each string length can only get more taut during tensioning. The anchors act as one-way clamps, only allowing string movement away from the center of the frame.

The system disclosed by U.S. Pat. No. 4,484,742 is not desirable for use with today's sports rackets for several reasons including the added weight factor gained by attaching the many required anchors along the periphery of the frame, the complexity in forming the racket frame with the mating cone-shaped recesses to accommodate the anchors. Other deficiencies of the system disclosed in U.S. Pat. No. 4,484,742 include the additional amount of time needed to insert each anchor and tension each string length, the undesirable trauma exerted to the string at each end by the clamping contact of each anchor, and the fact that if a particular string is over-tightened, it must be cut and replaced with a new one.

It is important that today's sports rackets remain lightweight, simple in construction and assembly and include a frame structure which can maintain proper string tension without exerting trauma to the strings. If excessive trauma is applied, the strings will break, either during tensioning or during use. The device shown in U.S. Pat. No. 4,484,742 cannot be used for tensioning any racket that does not include the above-mentioned anchors because without the anchors, the device cannot accommodate the additional length of the string caused by natural stretching of nylon. Nylon, for example, can stretch up to 40% its original length before retaining a tension of 55 lbs. The device of U.S. Pat. No. 4,484,742 cannot draw and hold the string to proper string tension without the use of the anchors because, apart from the anchors, there is no retaining means for maintaining a certain tension to a length of string while tightening it to a higher tension.

In other words, the device of U.S. Pat. No. 4,484,742 can only pull the string in predetermined increments, which are too small to overcome the increased length of the string due to stretching. The device must therefore rely on the clamping action of the otherwise undesirable anchors.

It is therefore an object of the present invention to provide a portable compact string tensioning device for use with sports rackets having a one or two length string design and that do not require clamping anchors along the periphery of the frame.

It is another object of the present invention to provide the portable stringing device with means for accommodating the additional length of nylon string generated during the tensioning procedure due to the natural stretching property of nylon string.

It is another object of the present invention to provide a method of stringing a racket frame with the present apparatus which does not require the use of a frame warp-preventing brace.

It is another object of the present invention to provide a portable and adjustable frame support bar to prevent frame warpage during traditional string tensioning procedures.

It is another object of the present invention to provide a portable stringing device which is both simple to use and inexpensive to manufacture.

DETAILED DESCRIPTION OF THE PREFERRED EMBODIMENT

Figure 1:
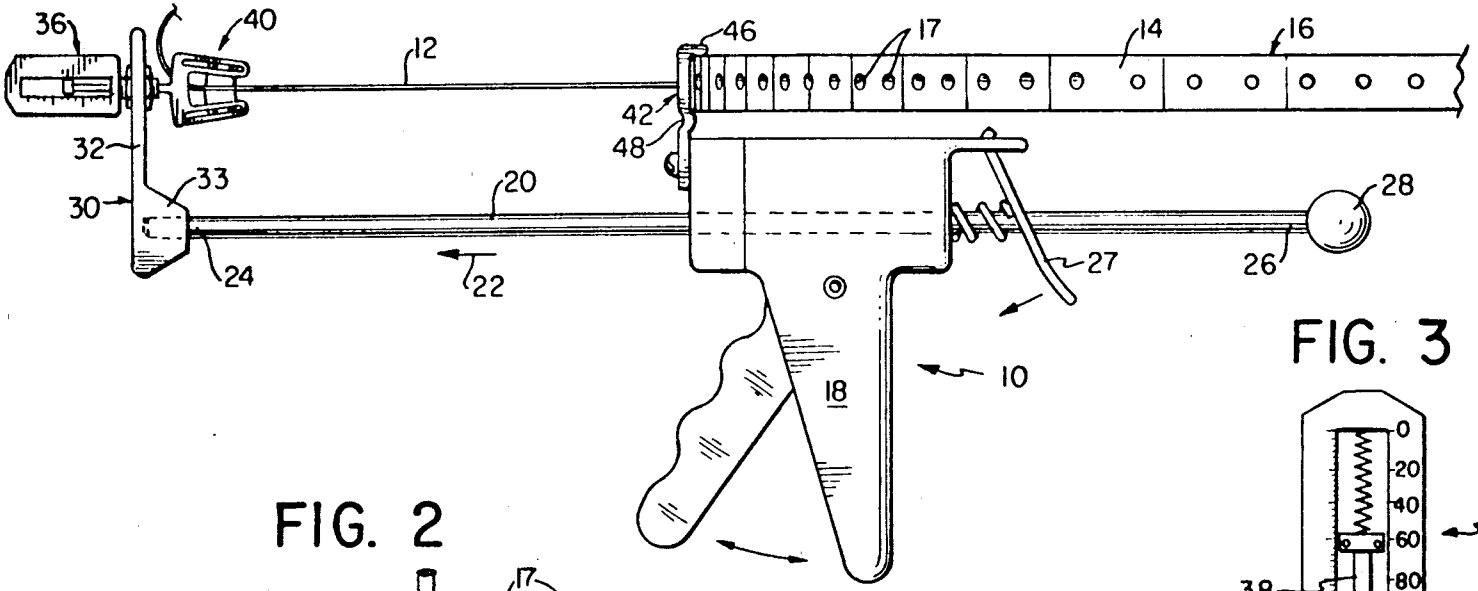
FIG. 1 is a side view of a sports racket being strung by the stringing tool of the present invention.

Referring to FIG. 1, a stringing tool 10, in accordance with the present invention is shown in its operating position, drawing a single length of string 12 taut along a string-line against a frame 14 of a sports racket 16. The sports racket 16 includes evenly spaced frame apertures 17 extending radially through the frame along its periphery, each aperture 17 being coplanar with each other. The stringing tool 10 includes an advancing mechanism 18, described in greater detail below, which gradually advances a rod 20 in the direction represented by arrow 22. The rod 20 has a front end 24 and a rear end 26. A stop-ball 28 is fixed to the rear end 26 using conventional techniques such as a set screw or screw threads. A front support arm assembly 30 is provided at the front end 24. The arm assembly 30 is preferably cast from a strong lightweight metal or plastic. The arm assembly 30 includes an extension arm 32 which extends perpendicular from the front end 24 of the rod 20. The length of the extension arm 32 from the rod 20 is preferably greater than the distance between the rod 20 and the string-line. The arm assembly also includes an attachment portion 33 which is preferably a threaded recess which engages equivalent threads formed on the front end 24 of the rod 20. Other equivalent methods conventionally known can be used to firmly attach the arm assembly 30 at the front end 24 of the rod 20. The extension arm 32 can also be incorporated with the rod 20 simply by bending the front end 24 of the rod 20 to the desired shape.

Figure 3:
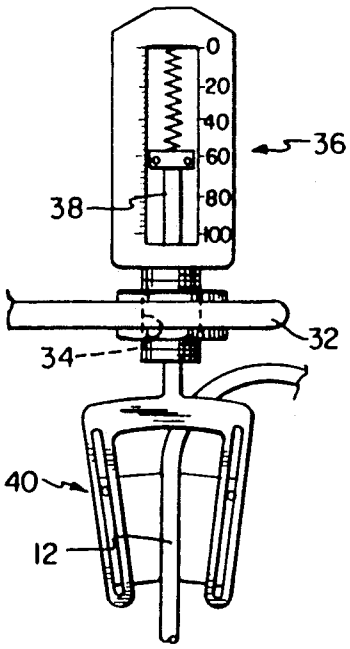
FIG. 3 is an enlarged plan view of a string clamp and string tension indicating gauge according to the present invention.

Along the remote end of the extension arm 32 is an opening 34 which is centered about the string-line. The opening 34 receives a portion of a spring-type tensioning gauge 36. The spring-type gauge 36 is used in this preferred embodiment due to its simplicity and its low cost. The gauge used for measuring string tension can be of any commercially available type including an analog dial-type, a digital type or one with a built-in preset-tension mechanism which limits the tension to a preset value. The spring-type tensioning gauge 36 is conventional and includes an indicator movable between zero pounds to over 80 pounds, for example. The actuator 38 (see FIG. 3) of the gauge 36 passes through the opening 34 of the extension arm 32 and supports a string clamp assembly 40. The string clamp 40 is a conventional pinch-type clamp that includes a frame structure and two slidable friction blocks of rubber/plastic or metal. An example of this conventional string clamp is shown in U.S. Pat. No. 4,125,259. The string 12 of the racket is held between the blocks which are forced together as the string becomes taut. The self-tightening string clamp is commercially available from the Ektelon Co. of San Diego, Calif., as well as Tennis Machines, Inc. of St. Louis, Mo.

Figure 2:
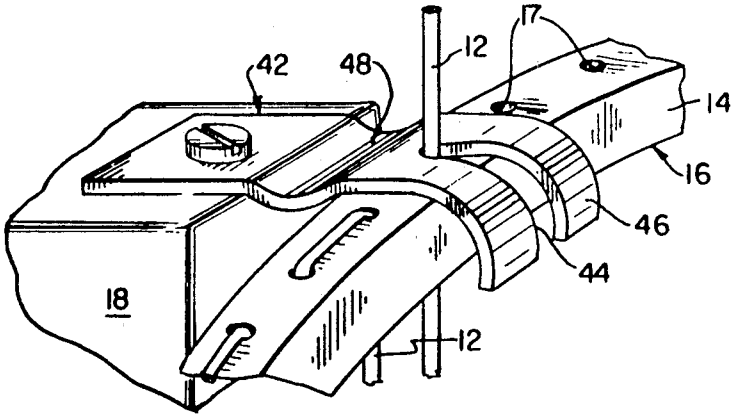
FIG. 2 is an enlarged isometric view of a support bracket assembly according to the present invention.

As shown in FIGS. 1 and 2, a support bracket 42 is attached to the advancing mechanism 18 by any conventional means such as threaded bolts. It could also be formed integral with the body of the advancing mechanism 18. In its simplest form, the support bracket 42 is a bar of rigid material such as a strong plastic or aluminum which extends parallel to the extension arm 32 in the same direction (towards the racket 16). The function of the support bracket 42 is to provide support to the stringing tool 10 during the tensioning procedure. During use, the support bracket 42 abuts against the frame 14 of the racket 16, lying adjacent to the aperture 17 through which the string 12 to be tensioned will pass. The support bracket 42 includes a slot 44 which is large enough to receive the string 12. The slot 44 allows the support bracket 42 to be positioned across the entire edge of the racket frame 14, as shown in FIG. 1. The support bracket 42 is preferably bent to define a holding channel which includes a bent end 46 and a ridge 48. Since the thickness of the edge of commercially available frames varies, the width of the holding channel is preferably large enough to accommodate the thickest frame edge of the rackets commonly used today.

The advancing mechanism 18 is preferably a modified caulking gun advancing mechanism which is commercially available in hardware stores for the application of tube-contained caulk. The two common types of caulking guns operate by advancing a piston and piston rod through the back end of a cylindrical caulking tube which is held firmly in place by a trough-like support. The piston and piston rod is advanced through the tube by either a friction advancing mechanism or a rachet-type pawl driven advancing mechanism. The present stringing tool 10 can incorporate a modified version of the known caulking gun advancing mechanisms to maintain tool simplicity and low cost, however, it is important that the triggering handle of the advancing mechanism provide sufficient leverage to the average operator so that high string tensions can be reached without difficulty.

The preferred advancing mechanism 18 of the present stringing tool uses everything of the known caulking gun except the trough-like support for receiving and supporting the caulking tube, which is removed. Of course, the advancing mechanism can be manufactured without the trough-like support for the benefit of the present invention. Also, if necessary, in stringing applications involving high string tensions (i.e., tennis rackets), the advancing mechanism can be modified to provide the user the necessary leverage advantage. The leverage increase can be created conventionally by increasing the length of the handle between one accessible end (user's end) and a pivot point with respect to the length of the handle between the other end (the advancing end) and the pivot point.

The result is a low cost and simple-in-construction, hand-held assembly for stringing a sports racket.

Figure 4:
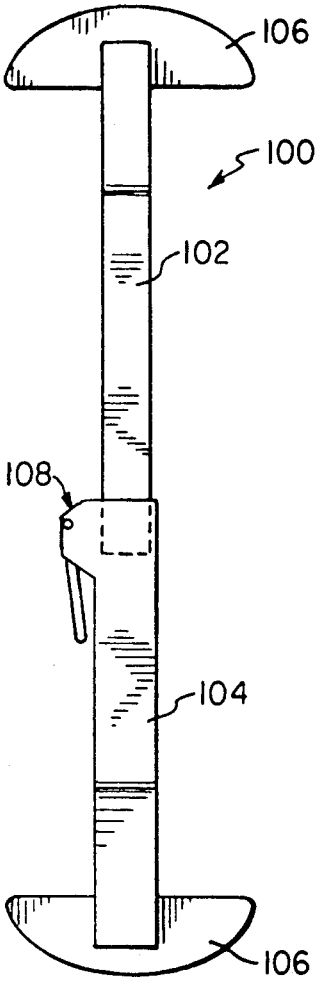
FIG. 4 is a plan view of a frame brace in accordance with a second embodiment of the present invention.
Figure 5:
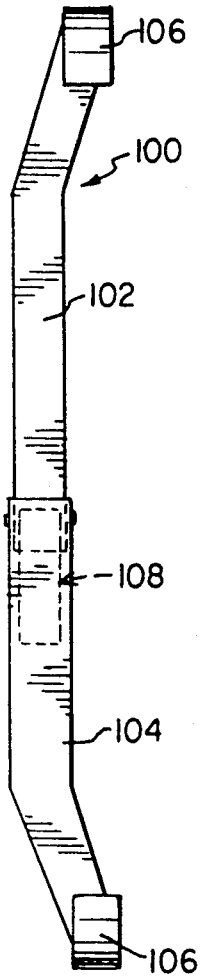
FIG. 5 is a side view of the brace of FIG. 4.
Figure 6:
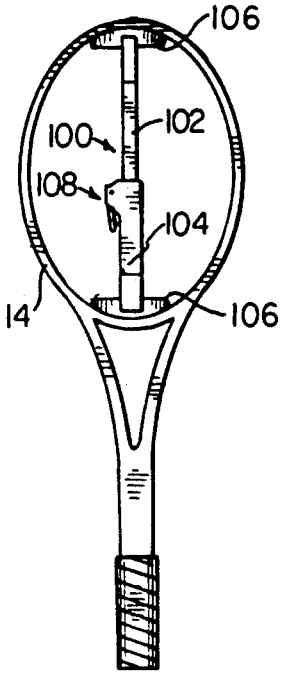
FIG. 6 is a front view of a tennis racket showing the present brace in operating position in accordance with the present invention.

The present stringing tool is designed to tension the strings of sports rackets having single or double length strings. These sports rackets do not include clamping anchors as required by the system disclosed in U.S. Pat. No. 4,484,742. The present device is capable of pulling each string (row and column) to its proper tension without the need of a frame clamp and can accommodate for the additional length of string generated by the stretching of the string. However, a portable frame brace is provided in the present invention should the user prefer the more traditional procedure for stringing rackets, as described above. Details of the preferred brace of the present invention is shown in FIGS. 4–6.

The operation of the present tensioning device is preferably used in accordance with the present method for stringing a racket, as shown in FIG. *7a–j*, and as described as follows.

The frame of the racket to be strung by the present device is initially empty, without strings. The immediate and preferred stringing procedure does not require use of the frame brace of the present invention. The strings are tensioned in an alternating fashion, between left column and right column and simultaneously, between upper and lower row so that at any given time during the tensioning procedure, the net result of applied forces the tensioned strings exert to the frame 14 will be no more than the force exerted by the tension of a single string. For purposes of clarity, the immediate description of the preferred method (referring to FIG. 7) only includes alternating the tensioning of strings between the left and right sides of a central vertical axis 50. It is understood, however, that the left-right alternating principle taught by the present method for stringing rackets can be easily modified to include alternating between upper and lower rows as well. For an example of the preferred method, a right vertical string can be first brought to proper tension, then an upper horizontal string (above a horizontal axis-not shown), then a vertical left string, a horizontal lower string, another vertical right string, another horizontal upper string and so on, always balancing the load of the racket frame.

Figure 7A:
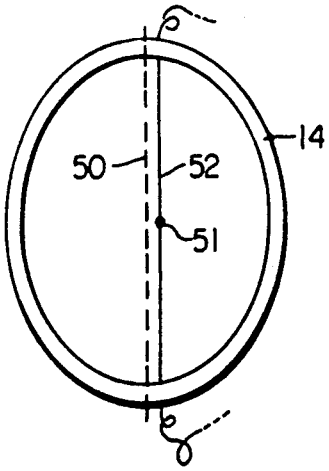
FIGS. 7*a–j* are front view representations of a racket frame showing the step by step, in part procedure of the present method for stringing rackets.
Figure 7B:
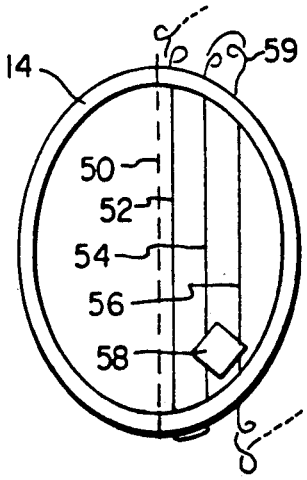

As shown in FIG. 7*a*, a length of string 12 (such as nylon) is inserted into two vertical central apertures 17 of the frame 16 either to the left or the right of the center axis 50. For this example, following with FIG. 7, a first right column 52 of string is formed. Point 51 along the first right string column 52 of FIG. 7*a* indicates approximately the midpoint of the entire string length 12 reserved for all the column strings. An adjacent second right column 54 is then formed beginning at the lower portion of the frame and on the right side of the first right column 52. An adjacent third right column string 56 is loosely formed, forming a loop 59 of string on the outside of the frame 14 between the second and third right columns.

In order to tension a particular column of string, for example, the first right column 52, an anchoring point must be created which does not interfere with the string being tensioned. In the present method, such an anchoring point is established through the use of a standard double string clamp which can clamp onto two adjacent strings to hold them with respect to each other.

A first of two standard double string clamps used in this shortened description of the present stringing method is represented in FIG. 7 by the box-shaped element 58. With the normal procedure of the preferred embodiment where both the vertical and horizontal strings are applied to the frame in an alternating fashion, a total of four double string clamps are necessary.

Figure 7C:
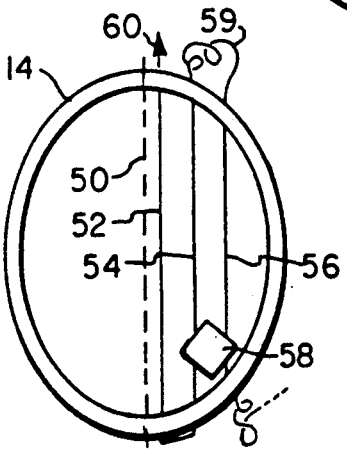
Figure 7D:
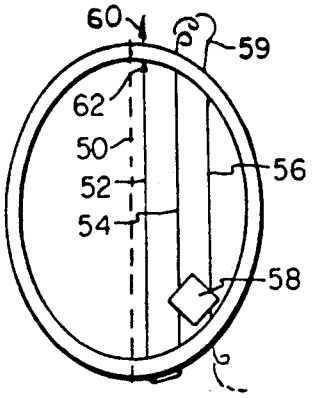

The first of two clamps 58 is fixed to both the lower portion of the second right column 54 and the third right column 56 so that the clamp 58 abuts the lower inside surface of the frame 14, as shown in FIG. 7*c*, thereby forming an anchoring point from which the first right column string 52 may be pulled taut. The loop 59 is maintained for the initial steps of the preferred stringing procedure, as described below.

With the anchoring point established, the present tensioning device 10 is placed into position against the frame so that the holding channel along the rear surface of the support bracket 42 abuts against the outside periphery of the frame 14 and supports the present device during tensioning. This is shown in FIGS. 1 and 2 (for reasons of clarity, the tensioning device is not included in detail in FIG. 7*a–j*, but the resulting pull force is represented by an arrow 60).

The slot 44 of the support bracket 42 is positioned around the string 12 lying outside the frame periphery. The rod 20 of the device is preferably positioned rearwardly so that the string clamp 40 is relatively close to the frame periphery. The remaining open end (in this case, the upper end) of the first right column string 52 is inserted between the two slidable blocks of the string clamp 40. The loose end of the string is pulled hand-taut until the string clamp 40 establishes a non-slip grip around the string. The advancing mechanism 18 is then operated with a hand from the operator, advancing the rod 20 forward which pulls both the string clamp 40 and the clamped string 12 forward.

As the string 12 becomes taut, as indicated and measured by the tensioning gauge 36, the rod 20 of the device will align generally normal to the outside periphery of the frame 14. The taut string 12 will force the support bracket 42 into tight engagement with the outside periphery of the frame 14 and retain its position. The rod is advanced until the first right column string 52 is stretched and tensioned to a proper value. The length of the rod 20 determines how much additional string length due to stretching can be accommodated during tensioning.

While the first right column string 52 is held at its stable proper tension, a reference mark 62 is made on it using red ink or any other appropriate marker. The mark 62 lies adjacent the inside surface of the frame 14 (in the case shown in FIG. 7*d*, adjacent the upper portion of the frame 14). The purpose of the mark 62 is to indicate to the operator the exact length of the first right column string 52 at the prescribed string tension. In other words, the operator knows that when the first right column string 52 is later re-pulled to tension, the prescribed tension will be reached when the red mark aligns with the inner surface of the frame 14. The use of the mark 62 is only necessary during the tensioning of the first column string (left or right}because once tensioned, the first column string must later be loosened and re-tensioned indirectly while tensioning an adjacent column string, as described below.

After the mark 62 is made, the rod 20 is returned to the rear of the device and the string tension released by releasing the catch arm 27. The present tensioning device is removed from the frame 14 and the first right column 52 loosens to zero lbs. tension.

Figure 7E:
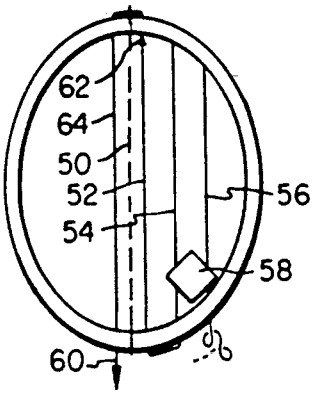

The remaining open end of the string 12 (non-anchoring point) is laced through adjacent vertical apertures to form the first left column 64, as shown in FIG. 7*e*, and re-connected to the present tensioning device, as described above, The first left column 64 and the first right column 52 are pulled taut together using the present tensioning device until the mark 62 on the first right column 52 reaches its previous position, indicating that the tension of the first right column 52 is correct. In order to reach the proper tension of the first right column 52, the first left column 64 must be tensioned higher than the proper tension to overcome any friction residing between the frame 14 and the string 12.

At this point in the stringing procedure, a second standard double-string clamping device represented as another box-like element numbered 66 and shown in FIG. 7 is applied to the columns. In order to prevent loss of tension of the first right column 52, the second clamp 66 is secured to the first right column 52 and the first left column 64, adjacent the upper portion of the frame 14 so that the established tension of the first right column string 52 is not lost after the tensioning device is removed from the frame 14 and re-positioned.

Figure 7F:
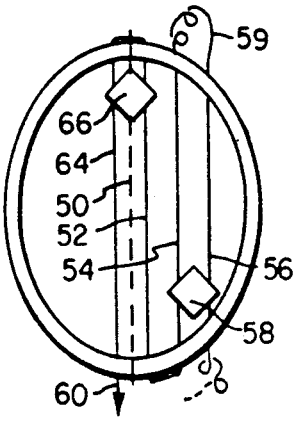

Once the second clamp 66 is in its position, as shown by FIG. 7*f*, the first left column 64 is loosened and re-tensioned to proper tension. The second clamp 66 is re-positioned to the lower portion of the frame 14, still secured to the first right column 52 and the first left column 62 so that the tension of both columns 52 and 64 is retained after the removal of the tensioning device 10.

Because no frame brace is being used with this preferred stringing procedure, the tensioning of the vertical column strings must alternate in order to balance the tension load exerted on the frame 14. Although not shown in FIG. 7, as stated above, the complete procedure of the present invention would require that a first upper (for example) row string be tensioned before the first left column string 64 was tensioned so that the frame 14 would be prevented from warping due to the tension of the vertical column strings.

The string 12 is laced through the vertical apertures 17 of the frame 14 to form a second left column 68. Again, the present tensioning device 10 is mounted to the frame 14 (represented as arrow 60 in FIG. 7*a-h*) and the second left column 68 is pulled to proper tension. Again, before releasing and re-positioning the tensioning device 10, the second clamp 66 is re-secured to the first and second left columns 64 and 68, as shown in FIG. 7*h*, so that the first right column 52 and both left columns 64 and 68 are all held at their proper tension.

Figure 7G:
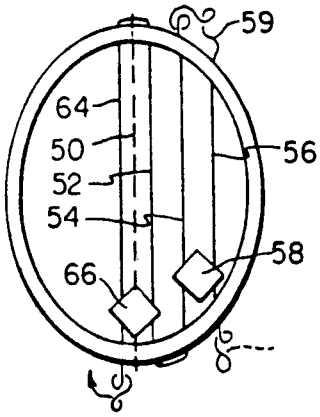
Figure 7H:
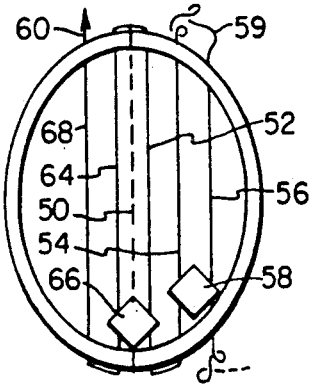
Figure 7I:
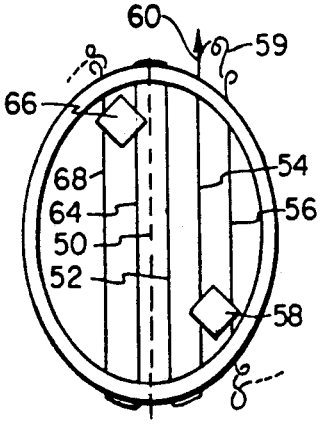

In FIG. 7*g*, the loop portion 59, which is protruding from the upper portion of the frame 14 under zero tension, is secured between the clamping blocks of the present tensioner so that only the second right column string 54 is taut and the third right column string 56 remains loose. The second right column 54 is brought to proper tension, as shown in FIG. 7*i*. While the second right column 54 is held at proper tension, the clamp 58 is released and repositioned to the upper portion of the frame 14, between the first right column 52 and the second right column 54 so that the tension of both right columns is maintained.

The third right column 56 is then brought to proper tension, like before, and the clamp 56 repositioned again to the lower portion of the frame 14 between the second right column 54 and the third right column 56 so that the tension of the third right column 54 is maintained.

Figure 7J:
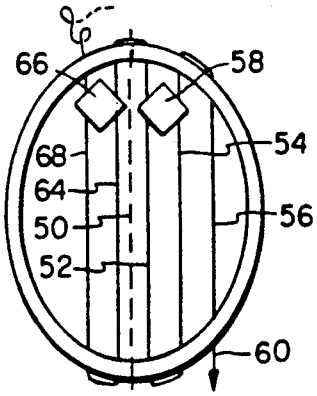

The sequence continues, as suggested by FIG. 7*j*, by forming a third left column, tensioning it and clamping it, then a fourth right column, fourth left, fifth right, and so on, until the frame 14 is completely strung, in this case, only with vertical strings.

In another embodiment of the present invention, a frame support brace is provided, as shown in FIG. 4, in order to prevent warping of the frame while stringing the racket following a more conventional stringing procedure (i.e., not alternating tensioned strings to equilibrate frame load). The brace 100, shown in FIG. 4, which is simple in construction and low in cost, includes two support members 102, 104, two fitted ends, 106, and a quick release locking mechanism 108. The support members 102 and 104 are tubular and are sized such that one can snugly slide into the hollow center of the other, in a telescoping arrangement. The quick release locking mechanism 108 is conventional and is preferably similar to those commonly found on tripods for locking the telesooping leg members. The locking mechanism 108 is fixed to one support member in such a manner that the relative position of the other support member can be selectively locked. The frame brace must be able to withstand the combined force of all vertical or all horizontal strings, in some cases upward to 1000 lbs. force.

In another embodiment of the present brace, one of the two telescoping support members 102 or 104 is provided with a threaded rod which extends into the hollow center of the other support member 102, 104. A nut is provided on the threaded rod so that as it is turned along the threaded rod it will displace the mating support member 102, 104 towards the direction of the advancing nut. In yet another embodiment of the brace, the two support members can be telescoping tubes, round in cross-section. Both the outside surface of the inner tube member and the inside surface of the outer tube member can be threaded with mating threads so that by turning one tube with respect to the other tube, the desired linear displacement is provided.

With whichever support members used, a fitted end 106 is attached to each exposed end of the mating support members 102, 104. The fitted ends 106 are known and are commercially available, called retainers. They are typically incorporated with the frame bracing system of the much heavier stringing machines of the prior art. The fitted ends 106 are used here to mount the brace 100 to the frame 14 and provide a distribution of the support of the brace to the inside surfaces of the frame.

The brace 100 is to be mounted to the frame in the same direction as the strings that are to be tensioned, either vertically or horizontally. The brace is inserted into the opening of the racket and expended by extending the telescoping support members 102, 104 until the fitted ends 106 abut the inside surfaces of the frame 14. Once the brace is in position, the locking mechanism 108 is activated so that the support members will lock with respect to each other and prevent the frame from warping. In other words, the brace 100 will equilibrate the loading of the tensioned main strings until balanced by the loading of the tensioned horizontal strings. The brace 100 is left in place until the entire racket is strung, the second set of strings (i.e., the horizontal set) replacing the supporting function of the brace.

An improved string clamp is also contemplated by the applicant. The string clamp is a tool for securing two strings of a racket to each other and thereby retaining their tension. The tool is similar in construction to commercially available locking pliers with a specific head attachment. The head attachment includes four or five pairs of fingers disposed along two tears. The tears are positioned on either side of a metal contact block and are operable towards and away from each other. Each pair of fingers are spaced from each other along the tears so that the two tears can be positioned within the strings of the racket, parallel to the two strings to be clamped, such as two vertical strings. The spaces between the finger pairs accommodate any transverse strings already on the racket, such as horizontal ones. The two vertical strings are positioned on either side of the contact block between the block and each respective tear, and are clamped there as each tear is moved against each respective side of the block.

The problem with such clamping tools is that the contact block, and the fingers are made from metal and do not provide a good gripping surface to hold the string. The result is that while stringing rackets at high tensions, such as 70 or 80 lbs, the string will slip from between the contact block and the tears.

It is contemplated by the applicant to provide a string clamp that has a roughened surface on the contact block and finger tears so that a better grip on the string is obtained. The gripping surface can be a formed by treating the metal parts, using known methods, during their manufacture, or securing a separate layer onto the contact surfaces. The separate layer could be a spray adhesive containing a grit compound or sand paper. The grit should be around size-400 to size-800 to avoid surface damage to the clamped string.

What is claimed is:

1. A portable, hand-held string tensioning device for tensioning a selected string portion of a sports racket, said device allowing one-handed operation, said sports racket including a frame portion and being of the type including separate lengths of a string wherein the string is woven through a plurality of apertures which are located evenly spaced along an outside peripheral surface of the frame portion and generally directed radially outward from a center point of the frame portion, the frame portion also having an inside peripheral surface, the string including a first end which is fixed relative to the frame and a second end which protrudes from one of the apertures, said device comprising:

a body portion;

a support bracket attached to said body portion for support said body portion against the outside peripheral surface of said frame;

a rod having a forward end slidably attached to said body portion and being movable relative to said support bracket;

means for selectively clamping the second end of the string portion to said forward end of said rod; and a hand trigger pivotally connected to said body portion and being rotatable with respect to said body portion away from said forward end, said hand trigger adapted to engage and advance said rod in a forward direction, thereby tensioning the string portion, said hand trigger being positioned such that it can be operated with only one hand.

2. The tensioning device according to claim 1 further comprising gauging means for directly measuring the tension of the string portion.

3. The tensioning device according to claim 1 wherein said rod is sufficient in length to overcome any additional string length generated during tensioning caused by material stretching of the string portion.

4. The tensioning device according to claim 1 wherein said support bracket includes a slot for accommodating the string projecting from the one aperture, and detents which nest around the frame for retaining said support bracket against the outside peripheral surface during tensioning.

5. A device as in claim 1, wherein said device further comprises a portable support brace, said support brace mounted within the frame portion and contacting the inner peripheral surface at at least two spaced apart points, said support brace positioned with respect to said body portion to prevent warping of the frame during tensioning of said string.

6. A device as in claim 1, wherein said device further comprises an angled plate connected to said body portion, said plate having an aperture for receiving said rod and selectively preventing rearward movement of said rod during operation.

* * * * *